US005707011A

United States Patent [19]

Bosio

[11] Patent Number: 5,707,011

[45] Date of Patent: Jan. 13, 1998

[54] SHOWER HEAD WITH PROTECTIVE HEAD INSERT

[75] Inventor: Orlando Bosio, Casaloldo, Italy

[73] Assignee: AMFAG S.r.l., Castelgoffredo, Italy

[21] Appl. No.: 357,966

[22] Filed: Dec. 16, 1994

[30] Foreign Application Priority Data

Dec. 20, 1993 [IT] Italy ..... MN930029 U

[51] Int. Cl.[6] ..... B05B 1/16; B05B 1/18

[52] U.S. Cl. ..... 239/447; 239/449

[58] Field of Search ..... 239/436, 443, 239/444, 446–449

[56] References Cited

U.S. PATENT DOCUMENTS 5,145,114 9/1992 Monch ..... 239/449 X 5,158,234 10/1992 Magnenat et al. ..... 239/449

5,356,078 10/1994 Bischoff ..... 239/447

FOREIGN PATENT DOCUMENTS 9008598 8/1990 WIPO .

*Primary Examiner*—Lesley D. Morris

[57] ABSTRACT

A shower head includes an outer casing that is shaped so as to form a tubular portion which contains an elongated insert for connection to a water supply duct. A cylindrical insert, connected with the elongated insert, is contained in a head of the casing and is locked by a plug provided with at least one outlet port for the exit of water. A ring is located peripherally with respect to the cylindrical insert, and is kept in position by the plug, and is adapted to abut against a raised portion which is provided at the end portion of the elongated insert so as to lock the elongated insert.

16 Claims, 2 Drawing Sheets

SHOWER HEAD WITH PROTECTIVE HEAD INSERT

BACKGROUND OF THE INVENTION

The present invention relates to a shower head.

It is known that there are shower heads which have an outer casing whose shape includes a cylindrical portion which acts as a handle, contains an elongated insert that has, at one end, a threaded portion for connection to a water supply duct, and is connected, at its other end, to a cylindrical insert which is contained in a tip portion of the casing and is locked therein by a plug which has at least one opening for the exit of the water conveyed by the shower head.

Many shower heads also include, inside the cylindrical insert, a device that allows switching from a central jet to a peripheral jet.

The outer casing is made of a material which has high-level aesthetic characteristics but is not suitable for withstanding mechanical stresses or temperature changes.

Shower heads included in the prior art have the drawback that they allow albeit partial contact of the water, conveyed by the inserts located inside said shower heads, with the outer casing: accordingly, the alternating presence of hot and cold water that occurs during the normal operation of the shower head causes temperature variations in said outer casing that are sufficient to cause cracks and breakage.

In some types of shower head there is also another drawback which arises from the fact that the elongated insert is locked inside the tubular portion of the outer casing, as required in order to contrast the thrusts produced by water pressure, by means of a screw which passes through said outer casing: this fact, in addition to being aesthetically unpleasant, introduces a discontinuity in the surface of the casing that allows dirt to accumulate and also produces in said casing local tensions that the material of said casing is unable to withstand without being negatively affected.

SUMMARY OF THE INVENTION

The aim of the present invention is therefore to provide a shower head in which the outer casing, while capable of being formed of highly aesthetic material, is fully protected against any kind of mechanical or thermal stress.

This aim is achieved by a shower head, according to the invention, which comprises an outer casing that is shaped so as to form a tubular portion which contains an elongated insert provided with a threaded portion at its end that protrudes from the casing and is associated, at its other end, with a cylindrical insert that is contained in a tip of the casing which is located at the end of the tubular portion in order to be locked thereat by means of a plug provided with at least one opening for the exit of the water conveyed by the shower head, characterized in that a ring is provided which is located peripherally with respect to said cylindrical insert, is kept in position by said plug, and is adapted to abut against a raised portion which is provided in the end portion of the elongated insert in order to lock it.

The shower head according to the invention is furthermore characterized in that the cylindrical insert has a watertight wall and has, at its lateral surface, a water inlet which is connected to the end portion of the elongated insert and also has, at one end face, at least one water outlet which is connected to the at least one opening provided in the plug, the connections of said openings being provided with gaskets that are adapted to prevent any contact of the water with the outer casing.

BRIEF DESCRIPTION OF THE DRAWINGS

Further characteristics and advantages will become apparent from the description of a shower head, illustrated only by way of non-limitative example in the accompanying drawings, wherein.

DESCRIPTION OF THE PREFERRED EMBODIMENTS

Figure 1:
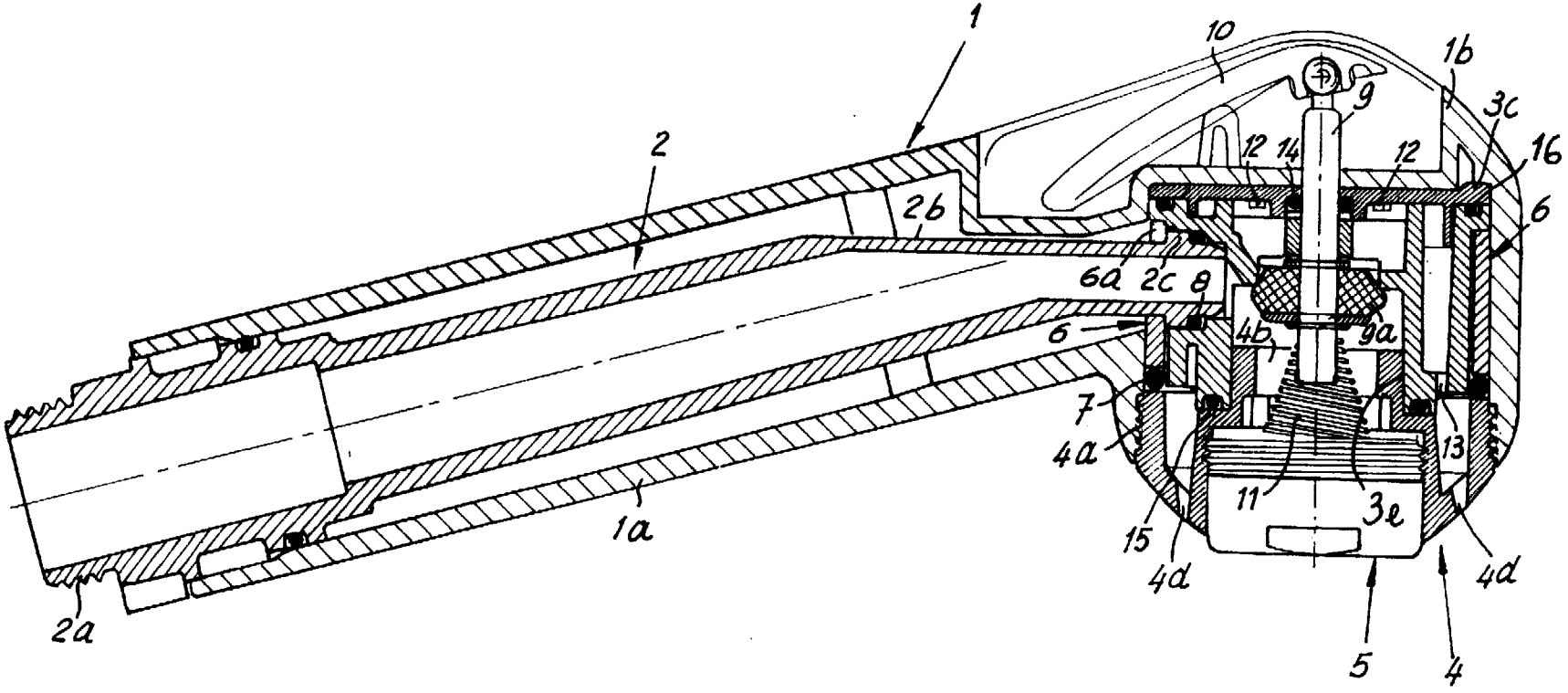
FIG. 1 is a cross-section view of the shower head according to the invention.
Figure 2:
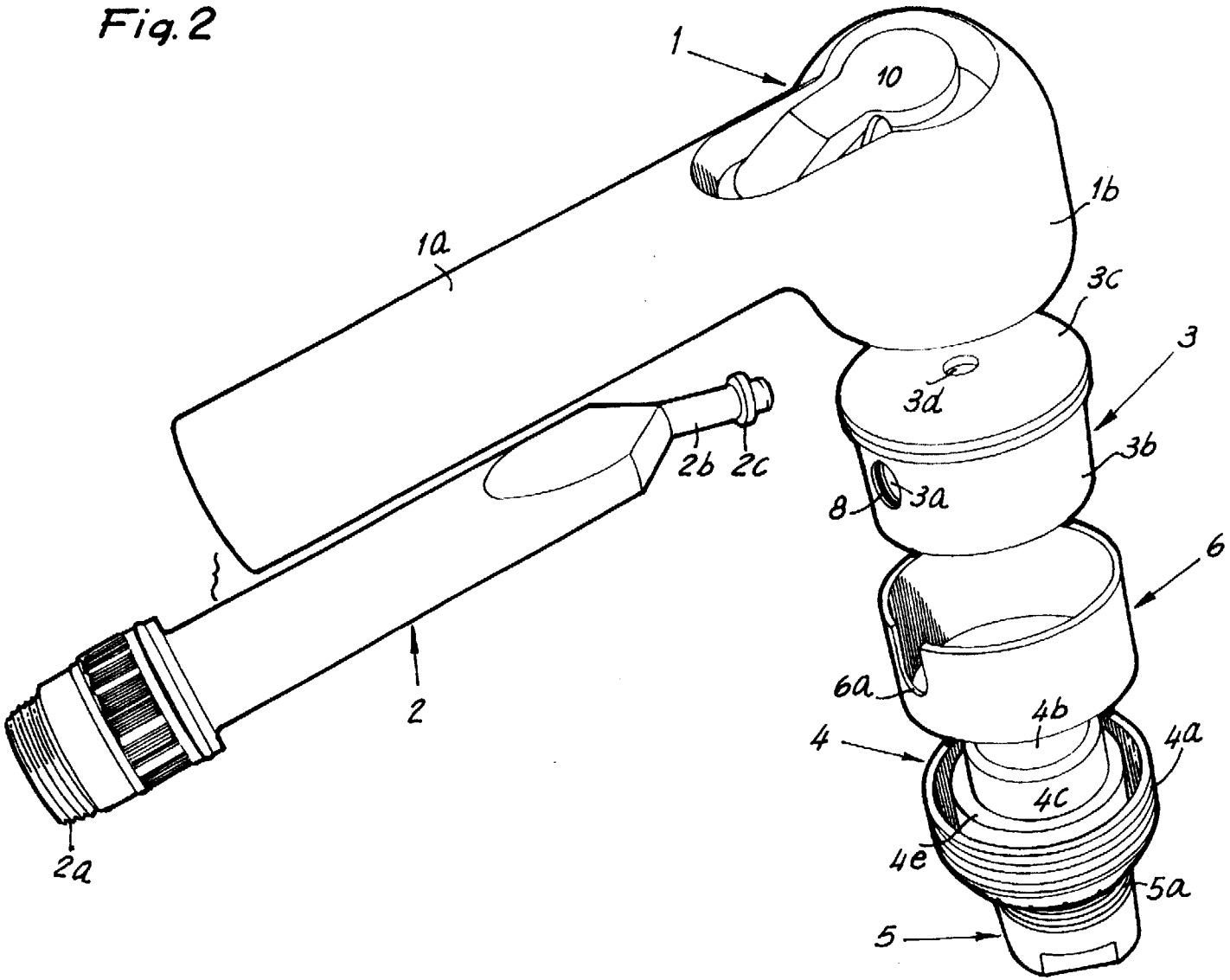
FIG. 2 is an exploded view thereof.

With reference to the above figures, the reference numeral 1 generally designates the outer casing of the shower head, which is made, as mentioned above, of a material that is aesthetically valid but cannot withstand mechanical stresses and temperature changes, and comprises a tubular portion 1*a* and a head 1*b* which are interconnected.

The elongated insert 2 is present inside the portion 1*a* and has, at its end that protrudes from the casing, the threaded portion 2*a* for connection to a water supply duct; at its other end, said insert is associated with the cylindrical insert 3 which is accommodated in the head 1*b* by inserting the final part of its end portion 2*b* in the single inlet or hole 3*a* provided on the lateral surface or wall of said cylindrical insert, as explained hereinafter.

The cylindrical insert 3, which will be described in detail hereinafter, is held in position inside the head 1*b* by means of the plug 4 which is associated with said head by means of the thread 4*a* and internally comprises a central water outlet port 4*b* formed in the extension 4*c* and peripheral outlets such as 4*d*; an aerator 5 is associated with the plug 4 at the central outlet by means of a thread 5*a*.

An important characteristic of the invention is constituted by the ring 6, which is located in the peripheral region of the cylindrical insert 3 and is held in position by the plug 4 with the interposition of the gasket 7; said ring is provided with the slot 6*a*, which is shaped complementarily to the end portion 2*b* of the elongated insert 2 and is adapted to abut against the circumferential raised portion 2*c* provided close to the end of the portion 2*b*.

This arrangement locks the elongated insert 2 with respect to the cylindrical insert 3 with the interposition of the gasket 8, which ensures the stability of the coupling and ensures optimum hygienic conditions.

The fact that the outer casing is not affected at all allows to protect it against mechanical or thermal stresses.

The cylindrical insert 3 is now described in detail; it internally comprises the conventional device that allows switching from a central jet to a peripheral jet and vice versa, which includes the rod 9 with a shutter 9*a* controlled by the pushbutton 10 in abutment against the spring 11.

In the position shown in FIG. 1, the water that reaches the cylindrical insert 3 from the elongated insert 2 flows directly to the outlet 4*b* of the plug 4 to produce the central jet; by actuating the button 10, the shutter 9*a* is moved so that it closes said outlet, and therefore the water enters the openings 12 and reaches outlets such as 13 that allow access to the outlets, such as 4*d*, for the peripheral jet.

The main characteristic of the described cylindrical insert 3 consists of the fact that since its walls are watertight it prevents contact of the water with the outer casing.

Said insert 3 in fact comprises the uninterrupted lateral surface 3*b*, which has the single inlet or hole 3*a* controlled by the gasket 8; the upper end face, constituted by the uninterrupted disk 3c which is associated with the lateral surface wall 3b in the presence of a sealing gasket 16 and only has the hole 3d, controlled by the gasket 14, for the passage of the rod 9; and a port 3e, at the lower end face, for accommodating the extension 4c of the plug 4, the water that produces the central jet passing through said port 3e, which controlled by the gasket 15 in contact with the surface 4e of the plug 4; the water that forms the peripheral jet instead passes through the outlets 13 and cannot make contact with the outer casing because of the above mentioned gasket 7.

In practice, the water conveyance circuit which is formed inside the shower head according to the invention and is constituted by the elongated insert 2, by the cylindrical insert 3, and by the plug 4, prevents any contact of said water with the casing.

It should be specified that the provision of an end face for the cylindrical insert that is shaped like the disk 3c is necessary in the described case of a shower head that comprises the device for switching from a central jet to a peripheral jet owing to constructive reasons linked to the presence of the ports 12: if this switching device is not provided, said end face might be formed monolithically with the side wall 3b.

In the practical execution of the invention, all the details may be replaced with other technically equivalent elements: thus, for example, the circumferential raised portion 2c may be replaced with a tooth which is adapted to make contact with a shallower axially arranged ring that does not have a notch such as 6a.

The materials employed, as well as the shapes and the dimensions, may furthermore be any according to the requirements.

What is claimed is:

1. A shower head having an outer casing being shaped so as to form a tubular portion and a head, said shower head comprising:

an elongated insert having a first threaded end protruding from said casing, and a second end, said second end comprising a raised portion;

a cylindrical insert being contained in said head of said casing;

a plug being provided with at least one water outlet port, said plug being connected to said head of said casing and engaging said cylindrical insert so as to retain said cylindrical insert in said head; and a ring which is located peripherally with respect to said cylindrical insert, said ring being engaged and kept in position by said plug so as to abut against said raised end portion of said elongated insert for locking said raised portion of said elongated insert with said cylindrical insert.

2. Shower head according to claim 1, wherein said ring is provided with a slot, said slot being shaped complementarily with respect to said second end of the elongated insert, said ring being arranged in abutment against said raised portion formed on said second end.

3. Shower head according to claim 2, further comprising a gasket interposed between said ring and said plug that keeps said ring in position.

4. A shower head having an outer casing being shaped so as to form a tubular portion and a head, said shower head comprising:

an elongated insert having a first threaded end protruding from said casing and a second end, said second end comprising a raised portion;

a cylindrical insert being contained in said head of said casing;

a plug being provided with at least one water outlet port, said plug being connected to said head of said casing and engaging said cylindrical insert so as to retain said cylindrical insert in said head; and a ring which is located peripherally with respect to said cylindrical insert, said ring being engaged and kept in position by said plug so as to abut against said raised portion of said elongated insert for locking said raised portion of said elongated insert with said cylindrical insert;

wherein said cylindrical insert comprises a lateral watertight wall having at a lateral surface thereof a water inlet port, said water inlet port being connected to said second end of said elongated insert, a water outlet port being further provided at an end face of said cylindrical insert, said water outlet port being connected to said at least one water outlet port of said plug, and gaskets being provided between said water inlet port and said second end and between said water outlet port of said cylindrical insert and said at least one water outlet port of said plug to prevent any contact of water with said outer casing.

5. Shower head according to claim 4, further comprising, inside said cylindrical insert, a device for switching from a central jet to a peripheral jet, wherein an end face of said cylindrical insert lying opposite to said end face provided with said water outlet port is shaped as a disk, said disk being associated with said lateral wall with a sealing gasket being arranged therebetween, said disk having further a central hole through which a rod passes for actuating said switching device, said hole being provided with a sealing gasket.

6. A shower head comprising an outer casing having a head portion;

a cylindrical insert arranged inside said head portion of said outer casing;

a water inlet port of said cylindrical insert for permitting water flow into said cylindrical insert;

an elongated insert for connection to a water supply and having an end portion accommodated inside said water inlet port of said cylindrical insert;

a plug connected to said casing and engaging said cylindrical insert for retaining said cylindrical insert inside said head portion of said outer casing;

at least one water outlet port of said plug in fluid communication with said water inlet port of said cylindrical insert for permitting water flow through said water inlet port and through said cylindrical insert and outwards through said at least one water outlet port of said plug; and a ring located peripherally about said cylindrical insert between said cylindrical insert and said head portion of said outer casing, said ring abutting against a raised portion at said end portion of said elongated insert such as to lock said elongated insert with said cylindrical insert.

7. The shower head of claim 6 wherein said plug engages said ring for retaining said ring in position between said cylindrical insert and said head portion of said outer casing.

8. The shower head of claim 6 further comprising a valve device for selectively switching a water flow type arranged inside said cylindrical insert and a central aerator arranged centrally in said plug, and wherein said at least one water outlet port of said plug comprises a central port in communication with said aerator and outer peripheral outlets.

9. The shower head of claim 6 wherein said cylindrical insert comprises a lateral wall at which said water inlet port is provided, and wherein said ring is provided with an open longitudinal slot arranged adjacent said water inlet port.

10. The shower head of claim 6 wherein said elongated insert is arranged inside a tubular portion of said outer casing.

11. The shower head of claim 9 wherein said raised portion is a circumferentially raised portion arranged between said water inlet port and said slot.

12. The shower head of claim 10 wherein said elongated insert comprises a threaded portion arranged opposite said end portion.

13. The shower head of claim 7 wherein said ring has a cylindrical wall portion extending between said plug and a portion of said cylindrical insert.

14. The shower head of claim 13 further comprising a sealing O-ring arranged between said cylindrical wall portion of said ring and said plug.

15. The shower head of claim 11 further comprising a sealing O-ring arranged between said circumferentially raised portion and said cylindrical insert.

16. The shower head of claim 8 wherein a water flow path is defined between said water inlet port of said cylindrical insert and said outer peripheral outlets of said plug, said water flow path being arranged out of contact with said head portion of said outer casing.

* * * * *